US006233946B1

(12) United States Patent
Masuda

(10) Patent No.: US 6,233,946 B1
(45) Date of Patent: May 22, 2001

(54) ACOUSTIC REFRIGERATION APPARATUS

(75) Inventor: Mitsuhiro Masuda, Osaka (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/399,737

(22) Filed: Sep. 20, 1999

(30) Foreign Application Priority Data

Sep. 22, 1998 (JP) ..... 10-267938
Mar. 25, 1999 (JP) ..... 11-081804

(51) Int. Cl.[7] ..... F25B 9/00
(52) U.S. Cl. ..... 62/6
(58) Field of Search ..... 62/6

(56) References Cited

U.S. PATENT DOCUMENTS 3,237,421 * 3/1966 Gifford ..... 62/88
4,114,380 * 9/1978 Ceperley ..... 60/721
5,165,243 * 11/1992 Bennett ..... 62/6
5,901,556 * 5/1999 Hofler ..... 62/6

* cited by examiner

*Primary Examiner*—William Doerrler
*Assistant Examiner*—Malik N. Drake
(74) *Attorney, Agent, or Firm*—Armstrong, Westerman, Hattori, McLeland & Naughton, LLP

(57) ABSTRACT

An acoustic refrigeration apparatus includes an acoustic wave generation device arranged directed to the channel of a hollow annular tube, and a regenerator provided at a predetermined position in the channel of the annular tube. A temperature gradient is obtained across the regenerator by an acoustic wave emitted from the acoustic wave generation device. Therefore, an acoustic refrigeration apparatus realizing a gas cycle approximating the Carnot cycle which is an ideal gas cycle, and realizing simplification of the structure and high efficiency of the apparatus is provided.

15 Claims, 10 Drawing Sheets

ACOUSTIC REFRIGERATION APPARATUS

BACKGROUND OF THE INVENTION

1. Field of the Invention

The present invention relates to acoustic refrigeration apparatuses, and particularly to an acoustic refrigeration apparatus directed to high efficiency and simplification in the structure of the apparatus.

2. Description of the Background Art

An acoustic refrigeration apparatus that effects refrigeration utilizing acoustic waves is conventionally known (for example, refer to Japanese Patent Laying-Open No. 58-52948: U.S. Pat. No. 4,398,398).

Referring to FIG. 8 showing an acoustic refrigeration apparatus 200, there are provided a resonance tube 202 having one end 202A closed and the other end 202B open, a speaker 201 opposite open end 202B of resonance tube 202 for acoustic generation, and a regenerator 203 having a plurality of layers of flat plates arranged within resonance tube 202.

The frequency of the applied current to speaker 201 is set so that the acoustic wave resonates in resonance tube 202. Upon generation of an acoustic wave from speaker 203 towards closed end 202A of resonance tube 202, a pressure distribution P is generated as shown in FIG. 8, exhibiting alternate generation of an antinode of great pressure variation and a node of small pressure variation. Also, the antinode and node are generated as to the gas displacement, as indicated by the arrow W in FIG. 8.

As a result, difference in temperature occurs at respective ends of regenerator 203. The low-temperature end and the high-temperature end of regenerator 203 effects cooling of the object of interest and heat rejection outwards via respective heat exchangers (not shown).

The cycle acoustic refrigeration apparatus 200 undergoes can be defined by the Brayton cycle including the four steps of adiabatic compression, isobaric change, adiabatic expansion, and isobaric change of a parcel of gas.

In the Brayton cycle provided by conventional acoustic refrigeration apparatus 200, heat is absorbed and rejected according to the difference between the temperature when the parcel of gas is expanded and the temperature of regenerator 203 and between the temperature when the parcel of gas is compressed and the temperature of regenerator 203, respectively. Therefore, the heat transfer process is irreversible. Thus, there is the disadvantage that the thermal efficiency is lower than that by the Carnot cycle.

The applicant of the present application has proposed an acoustic refrigeration apparatus that allows a reversible heat transfer process to realize a gas cycle approximating the Carnot cycle which is an ideal gas cycle (Japanese Patent Laying-Open No. 10-325625).

The basic structure and principle of this acoustic refrigeration apparatus will be described hereinafter with reference to FIG. 9 to FIG. 14D.

Referring to FIG. 9, an annular tube 1 in which an acoustic wave travels forms a channel of a hollow annular closed loop. The path length of annular tube 1 is set to be an integral number of the wavelength of the acoustic wave. In the following, it is assumed that the path length corresponds to the axial line in annular tube 1. Speakers 2 and 3 serving as acoustic wave generation devices are provided apart from each other by a distance equal to an odd-number of the quarter wavelength of the acoustic wave, and attached to annular tube 1 to emit an acoustic wave into annular tube 1.

An acoustic wave generation control device 50 is attached to speakers 2 and 3 to provide control so that the phase of the acoustic waves emitted from speaker 2 is delayed by the odd-number of the quarter period of the acoustic wave behind that from speaker.

The operating principle of the acoustic refrigeration apparatus will be described with reference to FIG. 10 here.

The acoustic wave issued from respective speakers 2 and 3 branches into two directions upon entering annular tube 1 to travel to the opposite directions respectively. The two progressive waves emitted from speakers 2 and 3 and travelling within annular tube 1 are superimposed with each other.

From the relationship of the arranged distance between speakers 2 and 3 and the phase difference of the acoustic waves, acoustic waves 2L and 3L travelling leftwards in the drawing go in phase to be amplified. Acoustic waves 2R and 3R travelling rightwards in the drawing go in antiphase to cancel each other. As a result, only the acoustic waves traveling in one direction (leftwards) remains. The remaining acoustic wave further circulates annular tube 1 to be further superimposed and amplified with an acoustic wave traveling behind in phase, resulting in increase of the amplitude as in the case of resonance.

Referring to FIG. 11, a regenerator 40 having high heat transfer rate and low pressure loss is provided within annular tube 1 of the acoustic refrigeration apparatus. The refrigeration principle thereof will be described with reference to FIG. 12.

The phase of progressive acoustic wave travelling through regenerator 40 is varied by the positions thereof. Focusing on a parcel of gas located at a certain position, an expansion change occurs when the parcel is displaced from its equilibrium position in the direction of the acoustic wave traveling and a compression change occurs when the parcel is displaced from its equilibrium position in the opposite direction of the traveling acoustic wave. By heat absorption and heat rejection by means of regenerator 40 in the expansion change and the compression change, the heat will be sequentially conveyed in the opposite direction of the traveling acoustic wave. Since this heat transfer process is reversible, thermal efficiency becomes higher than that of the conventional acoustic refrigeration apparatus.

The gas cycle of the above acoustic refrigeration apparatus will be described hereinafter with reference to FIG. 13 to FIG. 14D.

The Carnot cycle is constituted by an isothermal change and an adiabatic change. As shown in FIG. 13, the T-S diagram of the cycle is indicated as a rectangular shape diagram of A·H·G·D. A→H represents an adiabatic expansion change (constant entropy). H→G represents an isothermal expansion change. G→D represents an adiabatic compression change. D→A represents an isothermal expansion change.

In the case where the acoustic wave passes through in one direction a regenerator having superior heat transfer rate with a gas, pressure change occurs simultaneous to the reciprocation of the parcel of gas, as shown in FIG. 12. The pressure increases most rapidly and a parcel of gas is compressed most intensive when the parcel of gas passes through the most distant point from the equilibrium point in the direction of the acoustic wave traveling. Since the heat transfer rate of the regenerator is superior, isothermal compression is effected. This isothermal compression change is represented by D→A in FIGS. 13 and 14A.

When the parcel of gas is going on the way to the opposite direction of the traveling acoustic wave, heat is rejected along the temperature gradient of the regenerator. The parcel of gas is cooled down at an approximate isovolumetric change. This change is represented by A→B in FIGS. 13 and 14B.

When the parcel of gas passes through the most distant point from the equilibrium point in the opposite direction of the traveling acoustic wave, the pressure decreases most rapidly and the parcel of gas is expanded most intensively. This corresponds to the isothermal expansion change in which heat is absorbed from the regenerator. This stroke is represented by B→C in FIGS. 13 and 14C.

Similarly when the parcel of gas is going on the way to the direction of the traveling acoustic wave, isovolumetric change is exhibited in which heat is absorbed along the temperature gradient of the regenerator. This change is represented by C→D in FIGS. 13 and 14D.

Thus, the heat can be transported in the opposite direction of the traveling acoustic wave by a round of the cycle of D→A→B→C→D shown in FIG. 13. The cycle constituted by an isothermal change and an isovolumetric change is called the Stirling cycle, corresponding to the Carnot cycle having the adiabatic change replaced with the isovolumetric stroke.

Therefore, efficiency of a level equal to that of the Carnot cycle can be obtained in the above acoustic refrigeration apparatus.

However, this acoustic refrigeration apparatus has a portion of the pressure wave reflected without passing through the regenerator. Therefore, there was a problem that the efficiency of the apparatus is degraded by the energy of the reflected pressure wave. Furthermore, when a plurality of the above acoustic wave generation devices are provided, a device to adjust the phase of these acoustic wave generation devices is required.

SUMMARY OF THE INVENTION

An object of the present invention is to provide an acoustic refrigeration apparatus realizing a gas cycle approximating the Carnot cycle which is an ideal gas cycle, and realizing simplification of the structure and high efficiency of the apparatus.

According to an aspect of the present invention, an acoustic refrigeration apparatus includes an acoustic wave generation device arranged directed to a channel of a hollow annular tube, and a regenerator at a predetermined position in the annular tube. Temperature gradient is formed in the regenerator by the acoustic wave emitted from the acoustic wave generation device. Specifically, the acoustic wave generation device generates an acoustic wave at the resonant frequency of the annular tube. The acoustic wave generation device is preferably arranged in the proximity of the regenerator or at a position approximately 8/24 to approximately 11/24 of the annular tube path length distant from the regenerator along the path, particularly about 10/24 of the annular tube path length distant from the regenerator.

By this structure, emission of an acoustic wave of a frequency equal to the resonant frequency of the annular tube from the acoustic wave generation device causes a great pressure change in the annular tube, whereby reciprocation of the fluid is induced simultaneous to the amplification of the pressure change amount within the regenerator. Here, the pressure and the velocity changing in phase to cause a great temperature difference across the regenerator.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described hereinafter with reference to the drawings.

Figure 1:
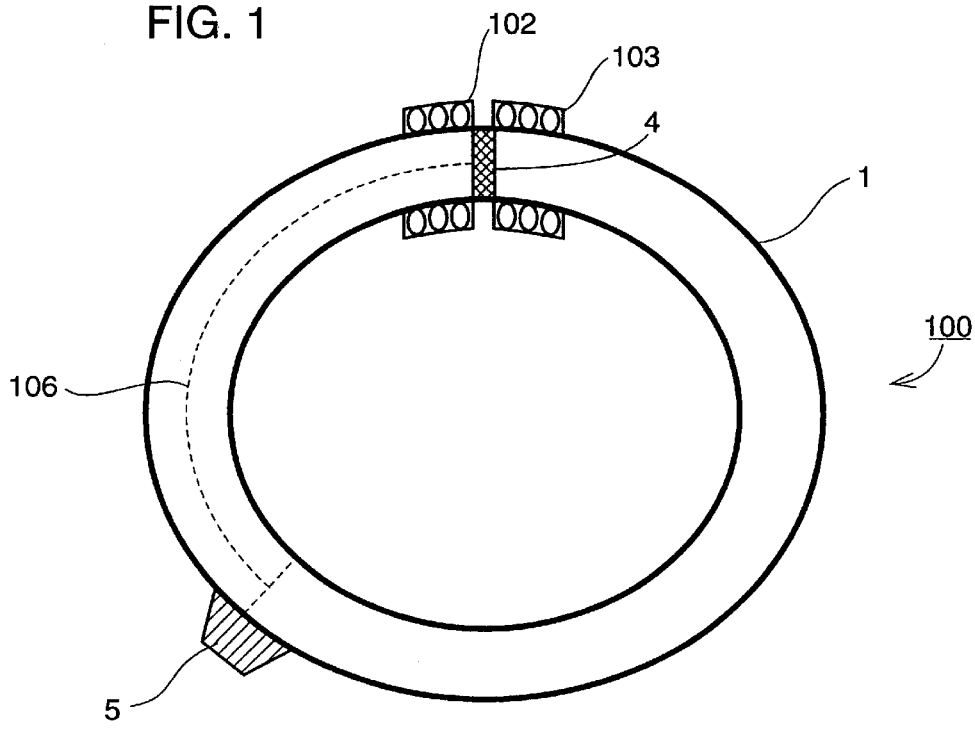
FIG. 1 is a schematic sectional view of an acoustic refrigeration apparatus according to an embodiment of the present invention.

FIG. 1 is a schematic sectional view showing the basic structure of an acoustic refrigeration apparatus according to an embodiment of the present invention.

Referring to FIG. 1, an acoustic refrigeration apparatus 100 forms a closed loop including a hollow annular tube 1. It is assumed that the length of the axial line in annular tube 1 is the annular tube path length in the present embodiment. A regenerator 4 is arranged at an appropriate position in annular tube 1. Regenerator 4 includes a regenerator pack (not shown) constituted by a wire mesh laminate or porous body formed of a material of high thermal conductance such as copper, copper alloy, steel, and stainless steel, or a plurality of plates parallel to each other. Speaker 5 functioning as an acoustic wave generation device generates an acoustic wave set at the resonant frequency of annular tube 1. Speaker 5 is arranged at a position approximately 8/24 to approximately 11/24 of the annular tube path length distant from regenerator 4 along the path. In the present embodiment, speaker 5 is arranged at a position 106 that is apart from regenerator 4 by a distance of approximately 10/24 of the annular tube path length.

At its respective ends of regenerator 4, a heat exchanger 102 corresponding to the high temperature side and a heat exchanger 103 corresponding to the low temperature side are wound around the perimeter face of annular tube 1.

Figure 3:
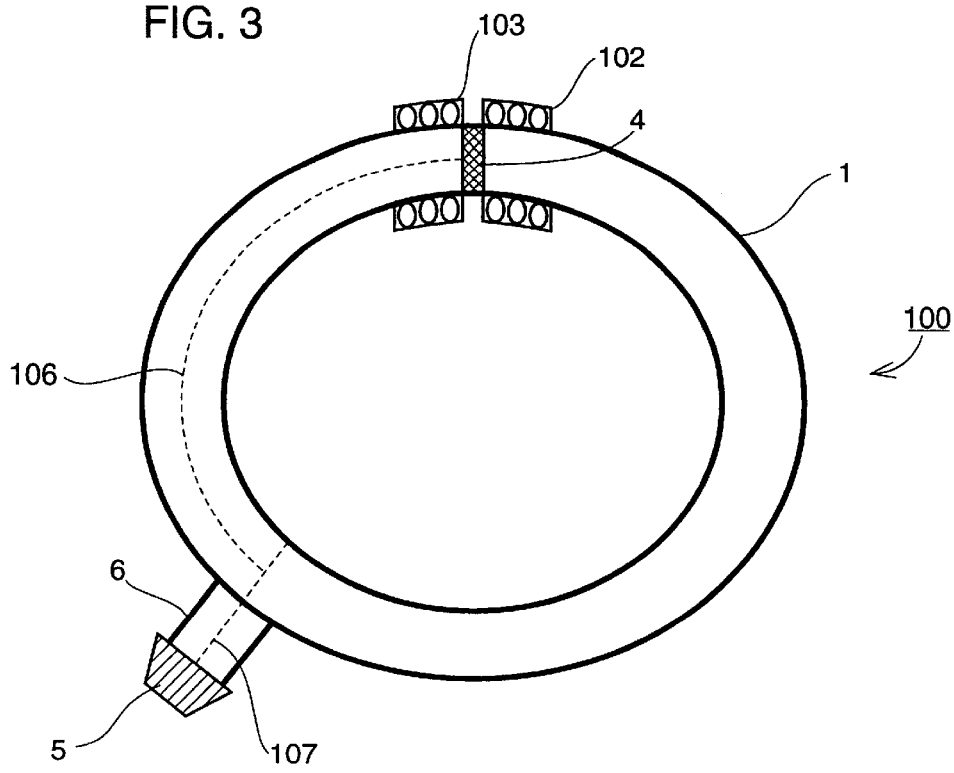
Figure 4:
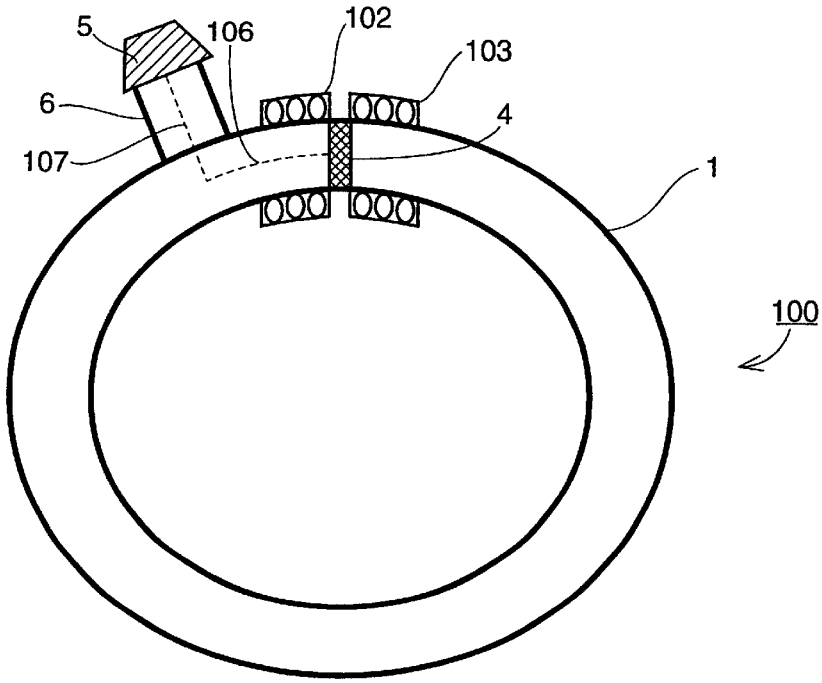

In the present embodiment, acoustic wave generation device 5 is directly attached to a portion of the wall of annular tube 1. Alternatively, speaker 5 can be provided at one end of a branch tube 6 protruding from annular tube 1 to provide the acoustic wave into annular tube 1, as shown in FIGS. 3 and 4. In this case, speaker 5 is arranged at a position where the length 107 of branch tube 6 connected to annular tube 1 becomes approximately 3% to 18% the path length of annular tube 1.

Figure 2:
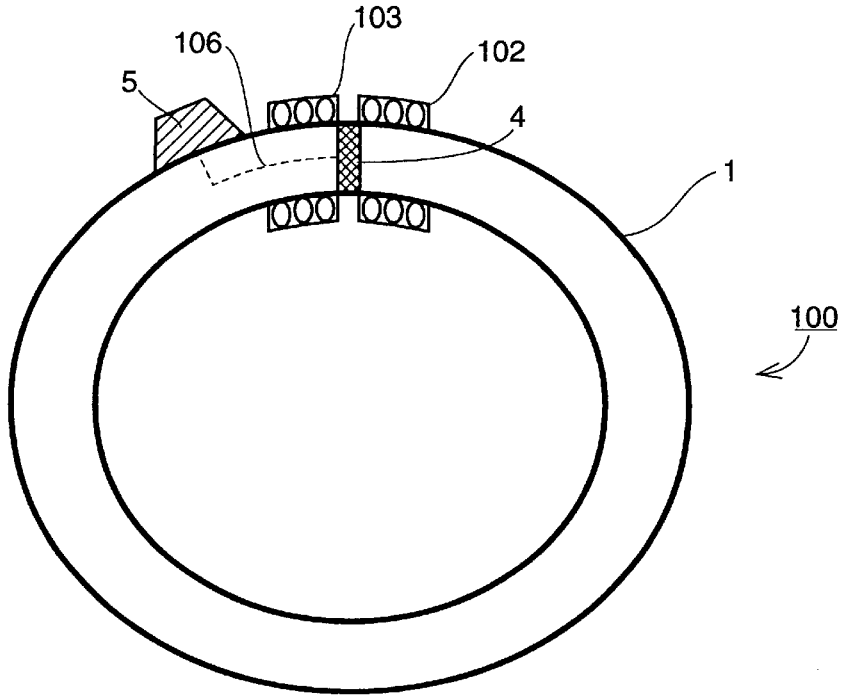
FIGS. 2–4 are schematic sectional views of an acoustic refrigeration apparatus according to another embodiment of the present invention.

Upon emission of a pressure wave having a frequency equal to the resonant frequency of the acoustic wave from speaker 5, a great pressure change occurs within annular tube 1. Here, reciprocation of the fluid is induced simultaneous to amplification of the pressure variation in regenerator 4. Also, the pressure and the velocity change in phase. By the pressure change and reciprocation of the fluid in regenerator 4, a gas cycle is implemented that repeats heat absorption by isothermal expansion and heat rejection by isothermal compression. A great temperature difference is exhibited at its respective ends of regenerator 4. Also, heat is absorbed from cold heat exchanger 103 and heat is rejected towards hot heat exchanger 102 located at its respective ends of regenerator 4. The function of a refrigerator or heat pump is achieved. A similar effect can be achieved even when speaker 5 is arranged at a position 106 in the proximity of regenerator 4, as shown in FIG. 2 or 4.

The reason why the above effect can be realized by arranging acoustic wave generation device 5 as above will be described hereinafter.

According to the general acoustic theory, it is known that, when the length of the flow path is sufficiently greater than the diameter of the flow path, the pressure wave in the tube can be approximated to a one-dimensional plane wave for analysis, facilitating calculation of the pressure and velocity. In the present invention, the equations of variation from the average values of the pressure P and the velocity U within regenerator 4 arranged in annular tube 1 as shown in FIG. 1 are derived from the acoustic theory. The equations of the present invention are as follows.

Equation 1

$$P = P_{d+} \cdot e^{i\omega\left(t - \frac{\sqrt{1-\frac{D}{\rho_m \cdot \omega} i}}{a} \cdot x\right)} + P_{d-} \cdot e^{i\omega\left(t + \frac{\sqrt{1-\frac{D}{\rho_m \cdot \omega} i}}{a} \cdot x\right)}$$

$$(0 \le x \le L_d)$$

Equation 2

$$U = \frac{P_{d+}}{\rho_m \cdot a \cdot \sqrt{1 - \frac{D}{\rho_m \cdot \omega} i}} \cdot e^{i\omega\left(t - \frac{\sqrt{1-\frac{D}{\rho_m \cdot \omega} i}}{a} \cdot x\right)} - \frac{P_{d-}}{\rho_m \cdot a \cdot \sqrt{1 - \frac{D}{\rho_m \cdot \omega} i}} \cdot e^{i\omega\left(t + \frac{\sqrt{1-\frac{D}{\rho_m \cdot \omega} i}}{a} \cdot x\right)}$$

$$(0 \le x \le L_d)$$

The meaning of the symbols in the above equations is set forth in the following.

$P_{d+}$: amplitude of acoustic wave traveling clockwise $P_{d-}$: amplitude of acoustic wave traveling counterclockwise $\omega$: angular frequency of oscillation $\rho_m$: average density of working gas $L_d$: length of regenerator 4 x: coordinate clockwise along the axial line of annular tube 1, with the left end of regenerator 4 as the origin a: speed of sound t: time D: constant of resistance proportional to velocity known as Darcy's law According to the thermoacoustic theory (Reference: A. Tominaga, "Thermodynamic Aspects of Thermoacoustic Theory", Cryogenics 1995 vol. 35, pp. 427–440), heat transfer rate is superior and the effect of isothermal reversible stroke is dominant in a regenerator formed of a material of low porosity. It is known that the heat flux by this effect can be evaluated quantitatively by the following equation 3.

Equation 3

$$Q_{prog} = -\beta T_m Re(Fs \cdot g) \cdot I$$

where I is the work flux. I is defined by pressure variation P and velocity U, indicated by the following equation 4. Therefore work flux I takes the maximum value when the pressure variation P and the velocity U change in phase.

Equation 4

$$I = \langle P \cdot U \rangle_t$$

The meaning of the symbols in the above equations is set forth in the following.

$Q_{prog}$: heat flux in regenerator

I: work flux in regenerator $\beta$: thermal expansion coefficient of working gas $T_m$: spacial average temperature of working gas Fs: constant related to heat capacity ratio of working gas to regenerator g: constant related to heat transfer rate Re( ): function representing real number part in ( )

<>t: value representing time average within <>

Figure 5:
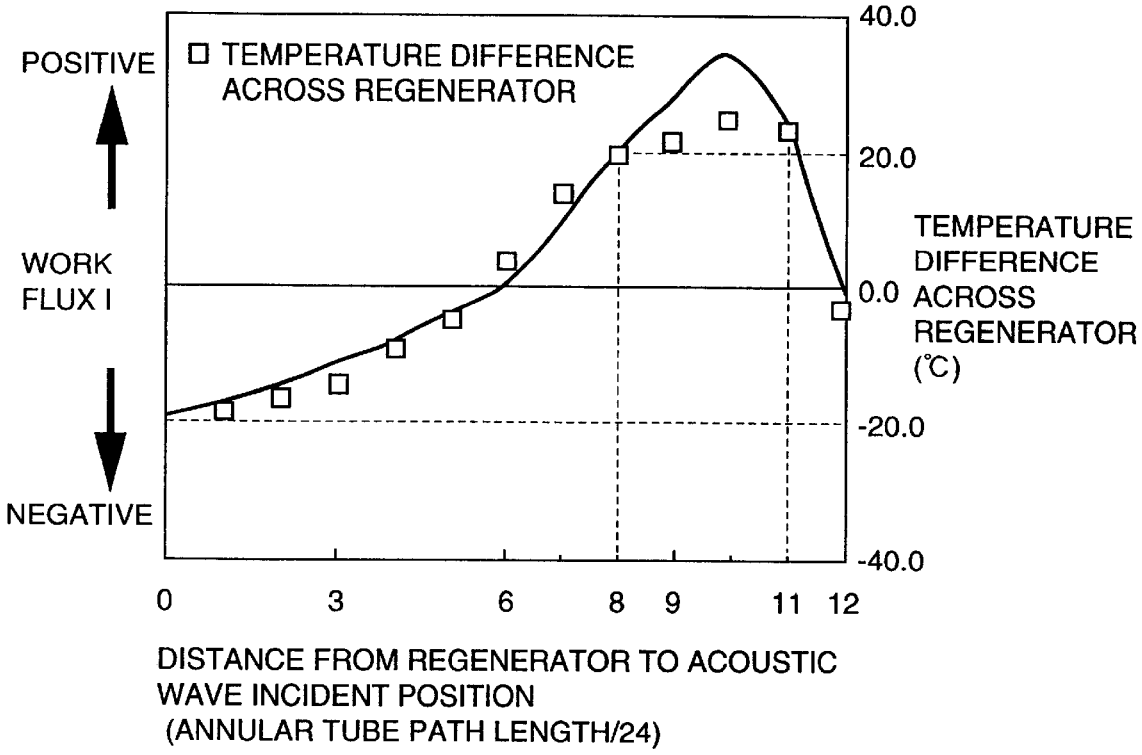
FIGS. 5 and 6 are diagrams to describe the logic and results of experiments of the acoustic refrigeration apparatus of the present invention.

It is appreciated from equation 3 that heat flux Qprog within regenerator 4 is proportional to work flux I. Calculating work flux I of regenerator 4 of annular tube 1 using the above equations 1, 2 and 4 with varying distance Lds from regenerator 4 to speaker (acoustic wave generation device) 5, the curve indicated by the solid line in FIG. 5 is obtained. From this result, it is considered that work flux I attains the positive and negative maxima with the most effective heat flux when the acoustic wave generation device is located in the proximity of regenerator 4 or located approximately 10/24 of the annular tube path length distant from one end of regenerator 4. It is to be noted that the direction of heat flux in the case that acoustic wave generation device 5 is located in the proximity of regenerator 4 is opposite to that in the case that it is located at approximately 10/24 of the annular tube path length distant from regenerator 4.

Figure 6:
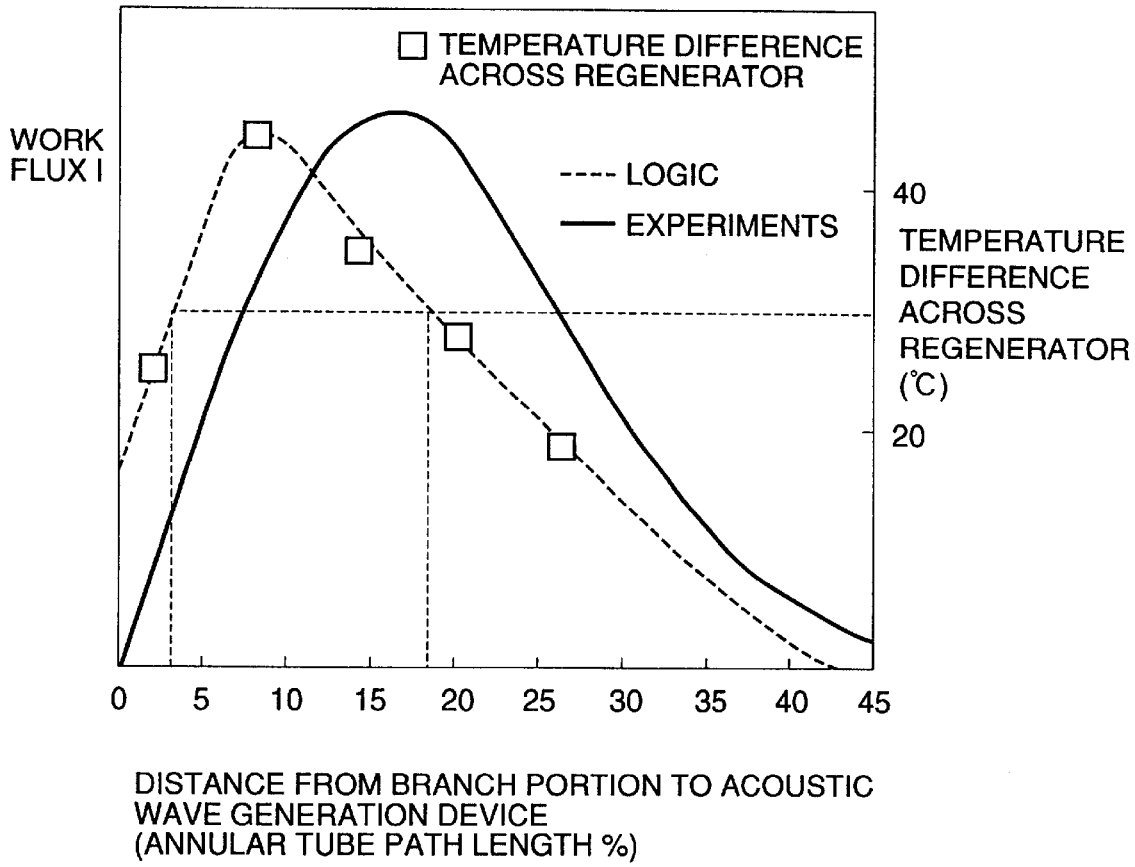

Referring to FIGS. 3 and 4, computing work flux I of regenerator 4 with varying distance 107 (Lbs) along a branch tube from the branching point to speaker 5, the curve indicated by the solid line in FIG. 6 is obtained. From this result, it is considered that work flux I is amplified by the distance 107 from the branching point to speaker 5 with the maximum work flux I when the distance Lbs is 16% of the annular tube path length, exhibiting the most effective heat flux.

It is appreciated from FIGS. 5 and 6 that the temperature difference across regenerator 4 is in the vicinity of 20 degrees when the acoustic wave generation device is located in the proximity of regenerator 4, or at a position approximately 8/24 to approximately 11/24 of the annular tube path length distant from regenerator 4 along the path. The efficiency of the apparatus can be improved by arranging speaker 5 functioning as the acoustic wave generation device at this position.

Figure 7:
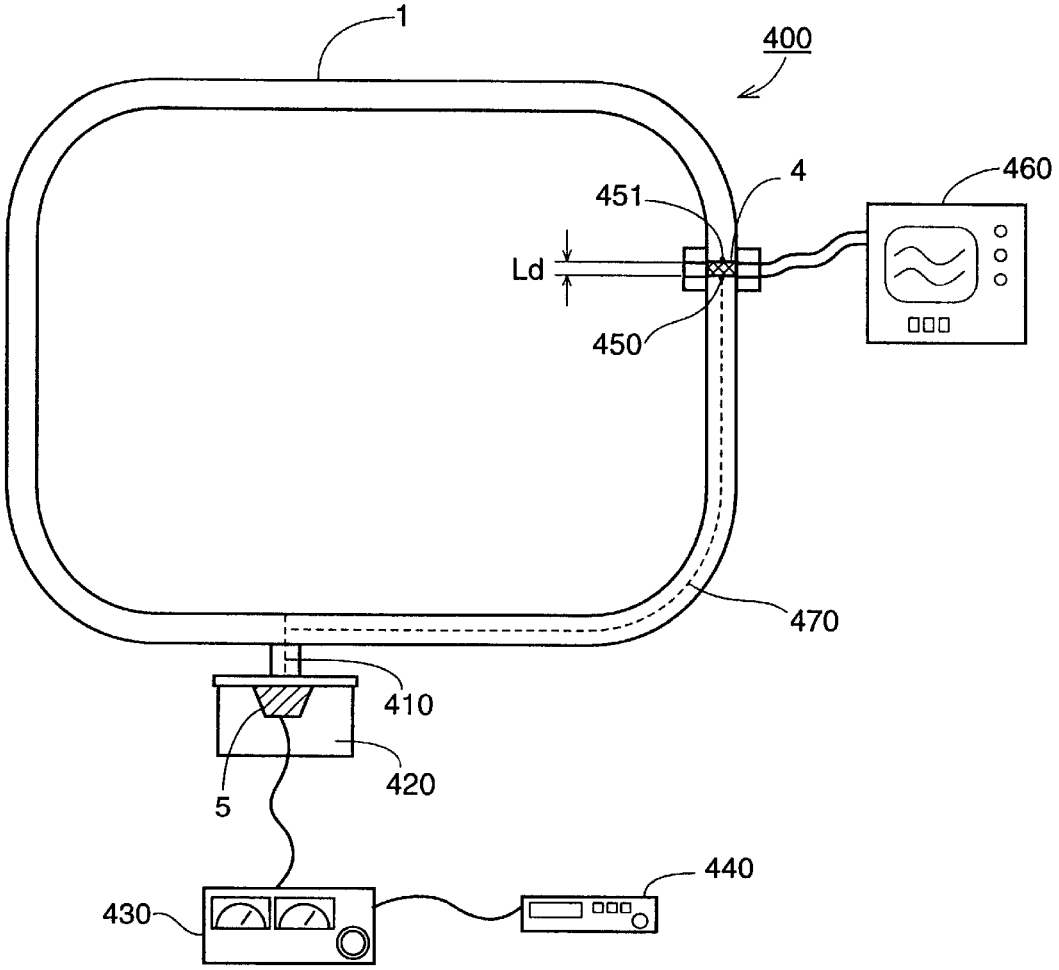
FIG. 7 shows a structure of components of experiments carried out to confirm the effect of the acoustic refrigeration apparatus of the present invention.
Figure 8:
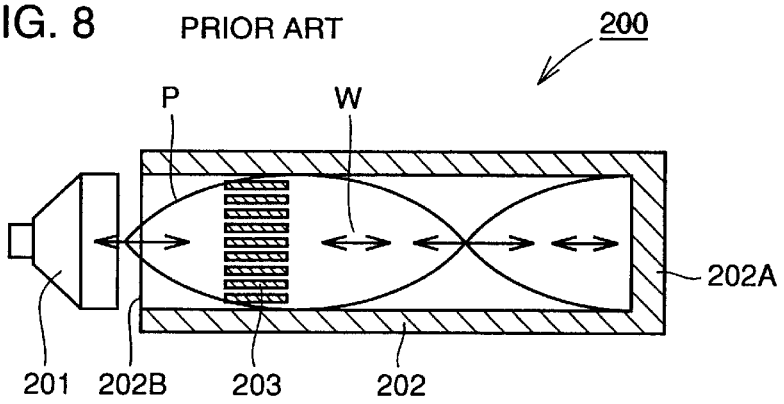
FIG. 8 PRIOR ART
FIG. 8 is a sectional view of a conventional acoustic refrigeration apparatus.
Figure 9:
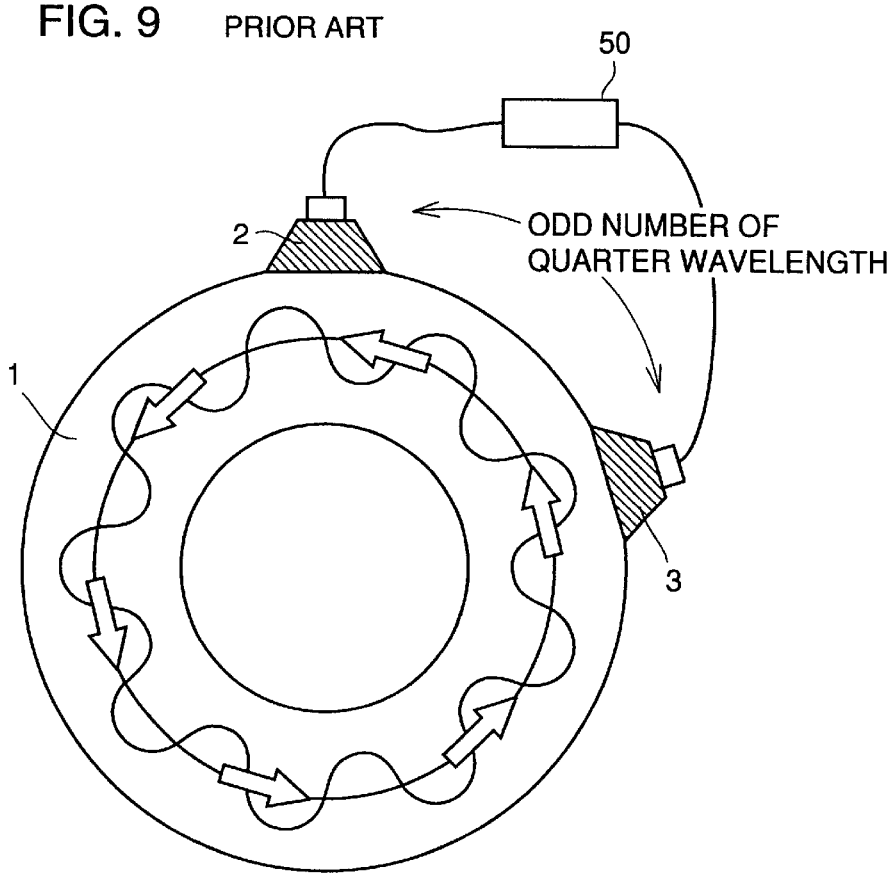
FIG. 9 PRIOR ART
FIGS. 9 and 10 are diagrams to describe the operation principle of the acoustic refrigeration apparatus disclosed in Japanese Patent Laying-Open No. 10-325625.
Figure 10:
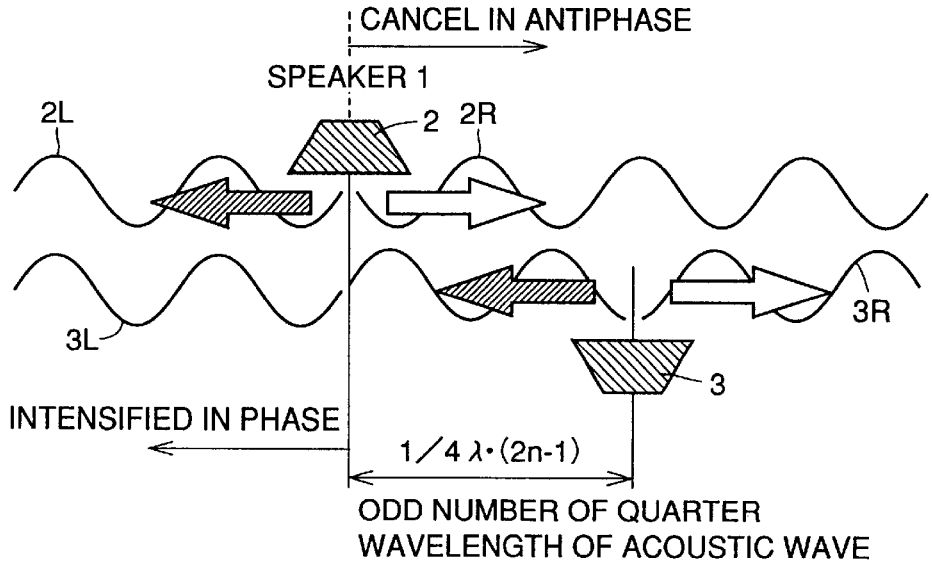
FIG. 10 PRIOR ART
Figure 11:
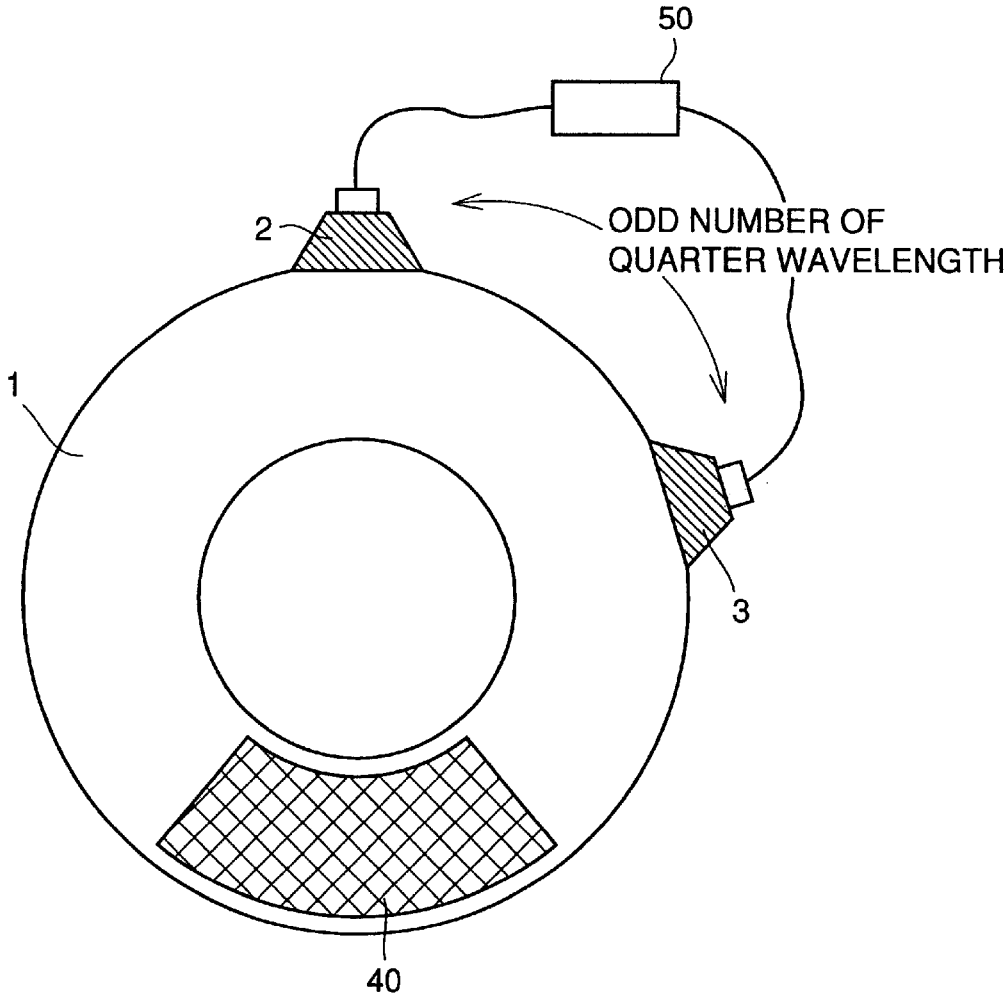
FIG. 11 PRIOR ART
FIG. 11 is a schematic diagram showing a basic structure of the acoustic refrigeration apparatus of FIGS. 9 and 10.
Figure 12:
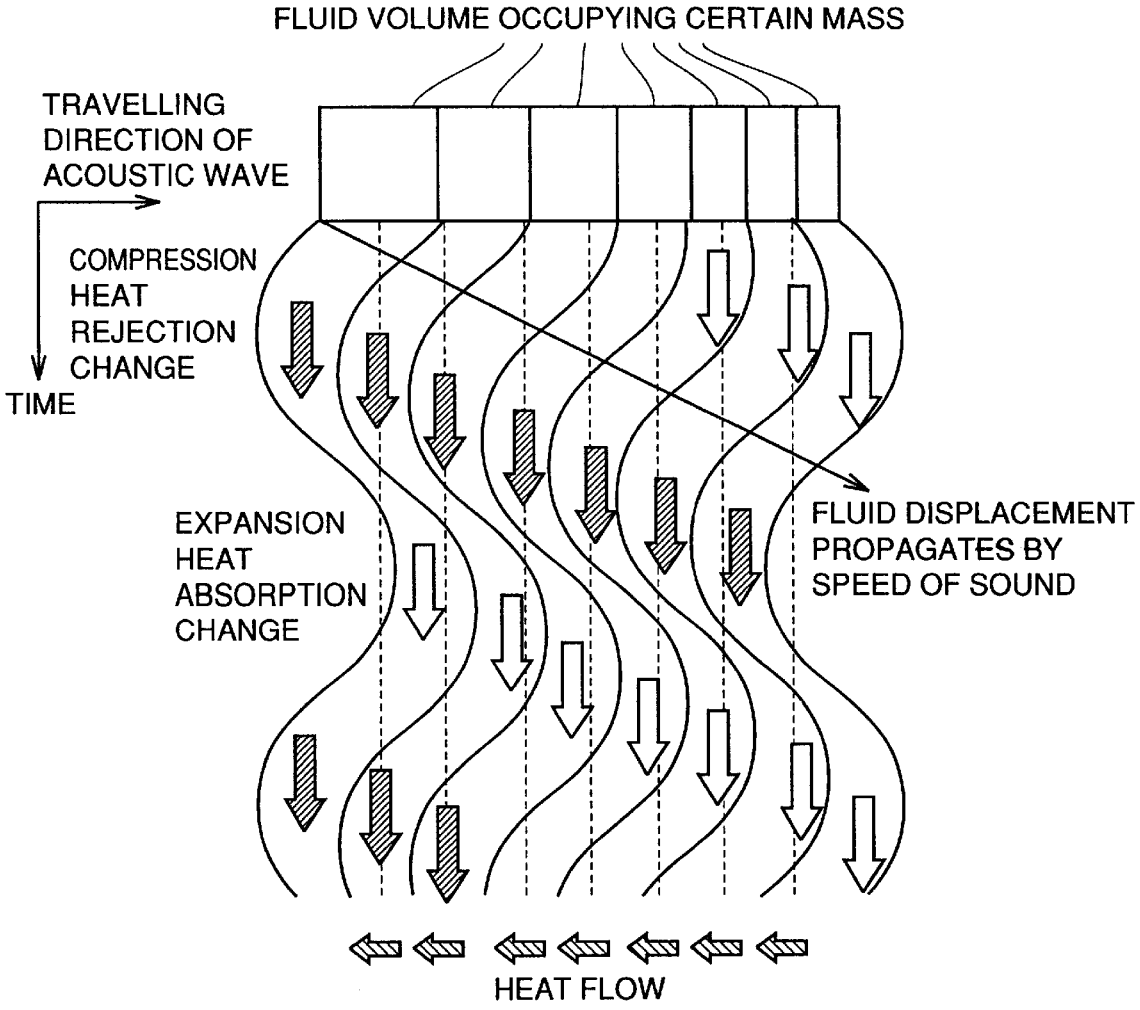
FIG. 12 PRIOR ART
FIG. 12 is a diagram to describe the heat conduction stroke of the acoustic refrigeration apparatus of FIGS. 9 and 10.
Figure 13:
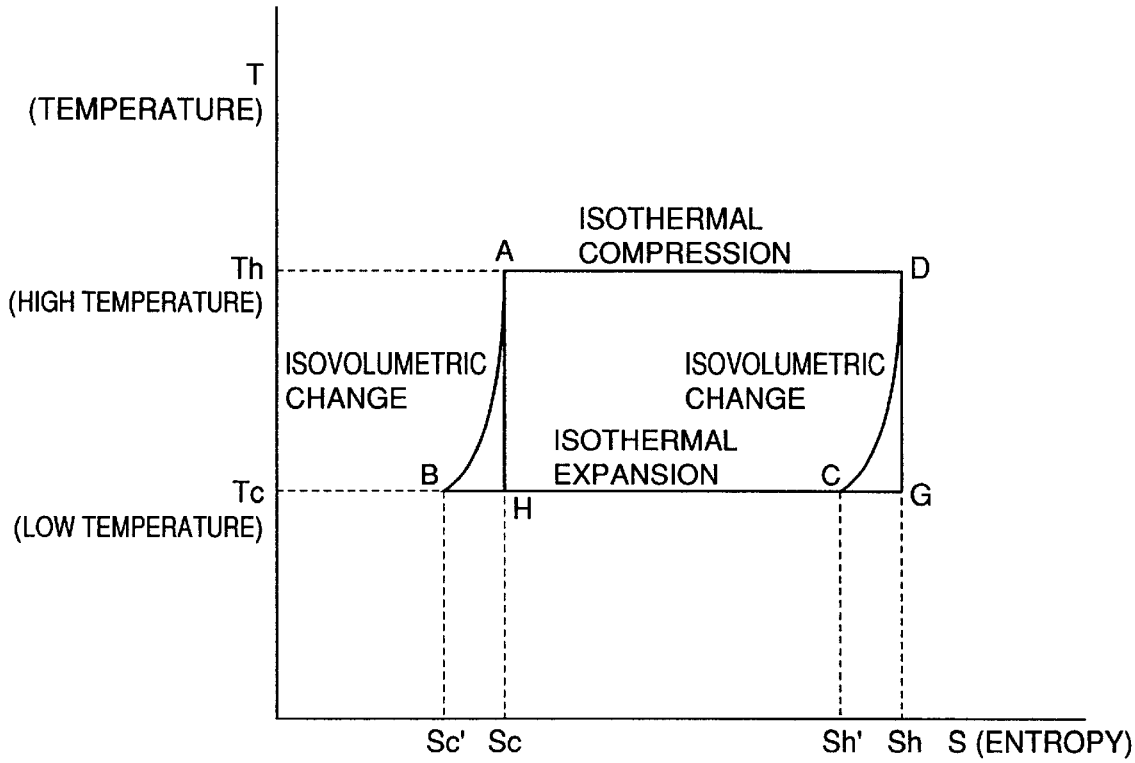
FIG. 13 PRIOR ART
FIG. 13 is a T-S line diagram representing the refrigeration cycle of the acoustic refrigeration apparatus of FIGS. 9 and 10.
Figure 14A:
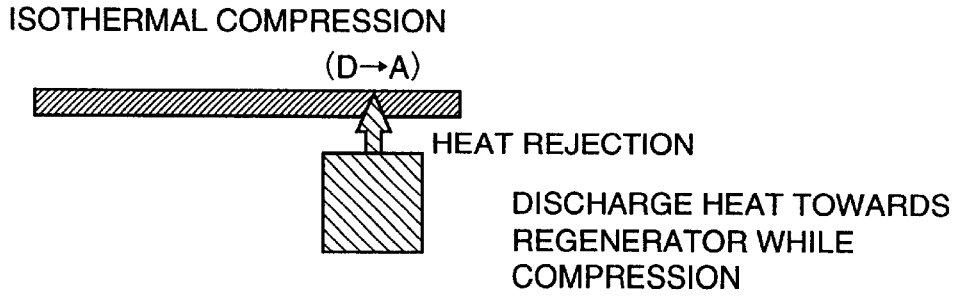
FIG. 14A PRIOR ART
FIGS. 14A–14D are diagrams to describe the refrigeration cycle.
Figure 14B:
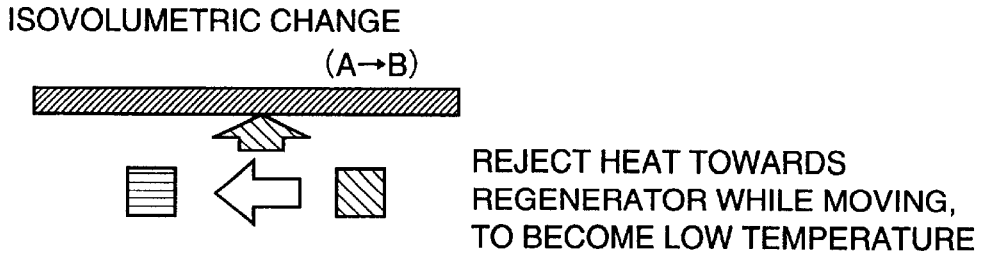
FIG. 14B PRIOR ART
Figure 14C:
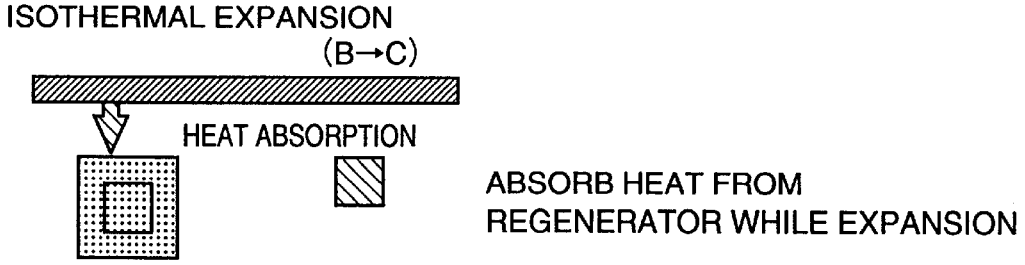
FIG. 14C PRIOR ART
Figure 14D:
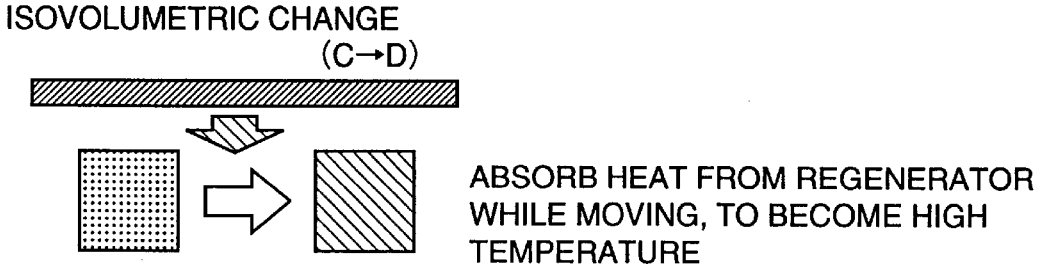
FIG. 14D PRIOR ART

Experiments were carried out to confirm the validity of the result according to the above theory. Referring to FIG. 7, acoustic refrigeration apparatus 400 includes a hollow annular tube 1 of approximately 3.4 m in path length. Speaker 5 (acoustic wave generation device) is attached to annular tube 1 via a branch tube 410. A cover 420 is attached at the back side of speaker 5. An amplifier 430 and a signal generator 440 are connected to speaker 5 to generate a predetermined pressure wave.

Regenerator 4 is provided at annular tube 1. A thermocouple 450 and 451 is attached at its respective ends of regenerator 4. An oscillographic recorder 460 is connected to read the temperature difference obtained from the thermocouple.

Measurement of the performance of acoustic refrigeration apparatus 400 of the above structure is carried out by driving speaker 5 at the resonance frequency of the assembled tube with annular tube 1 and branch tube 410. The effect was evaluated by altering distance Lds 470 between branch tube 410 to which speaker 5 is connected and regenerator 4. The result is represented by the open rectangle in FIG. 5. Similarly, the effect was evaluated by altering the length Lbs of branch portion 410. The result is shown in FIG. 6. Work flux I and the temperature difference at its respective ends of regenerator 4 are scaled to facilitate visual relationship in FIGS. 5 and 6.

It is appreciated from the result of FIG. 5 that the results of the experiment as to the effect of Lds according to the apparatus of FIG. 7 is in good agreement with that of the above-described theory. It was confirmed that the above theory is valid.

From the result of FIG. 6, it is noted that although the maximum value differs, the effect of Lbs according to the apparatus of FIG. 7 is in good agreement qualitatively with that of the result according to the theory. The losses occurring in practice such as regenerator loss have to be considered for more accurate theory.

Thus, by arranging speaker 5 functioning as the acoustic wave generation device at a position in the proximity of regenerator 4 or at a position approximately 8/24 to approximately 11/24 of the annular tube path length distant from regenerator 4 along the channel to exhibit approximately 20 degrees in the temperature difference at respective ends of regenerator 4, as shown by the result of FIG. 5, the efficiency of the apparatus can be improved.

Also, by adjusting the length of branch tube 410 to be approximately 3% to 18% the annular tube path length exhibiting approximately 20 degrees in temperature difference between its respective ends of regenerator 4, as shown by the experiment result of FIG. 6, and thus arranging speaker 5, the efficiency of the apparatus can be improved.

When speaker (acoustic wave generation device) 5 is directly provided at annular tube 1, the distance between speaker (acoustic wave generation device) 5 and annular tube 1 cannot be set to exactly zero due to structural limitations. There will be a distance (connection section gap) of 1–2% with respect to the annular tube path length. The theoretical values shown in FIGS. 5 and 6 take into account this connection section gap. The range in which the desirable effect of the present embodiment is obtained corresponds to speaker (acoustic wave generation device) 5 located in the range of appropriately 3 to 18% of the annular tube path length distant from the branching point along branch tube 410. Therefore, it is considered that whether the connection section gap is to be taken into account or not has no influence.

While there has been illustrated and described what are at present considered to be the preferred embodiments of the present invention, it will be understood by those skilled in the art that various changes and modifications may be made without departing from the scope of the present invention.

For example, the above embodiments were described in which only one acoustic wave generation device 5 is employed. However, a plurality of acoustic wave generation devices 5 can be arranged. It is to be noted that there is an advantage of a complex phase adjustment device and the like to adjust the phase is dispensable since the acoustic waves from the plurality of acoustic wave generation devices are either in phase or antiphase.

Also, the above embodiments were described in which acoustic wave generation device 5 is employed as the input device. Alternatively, acoustic wave generation device 5 can be employed as the output device with the heat exchangers installed at its respective ends of regenerator 4 as the input device to provide the function as an engine cycle.

According to the present invention, reciprocation of the fluid is induced simultaneous to amplification of the pressure variation in the regenerator. Furthermore, the pressure and the velocity change in phase. Therefore, a great temperature difference can be generated at its respective ends of the regenerator. The efficiency of the apparatus can be improved.

Efficiency higher than that of the conventional device can be achieved with only one acoustic wave generation device in the present invention. Therefore, the further advantage of simplifying the structure of the apparatus is obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An acoustic refrigeration apparatus comprising:

an acoustic wave generation device directed to a channel of a hollow annular tube, and a regenerator provided at a predetermined position of the channel of said annular tube, wherein a temperature gradient is generated in said regenerator by an acoustic wave generated from said acoustic wave generation device.

2. The acoustic refrigeration apparatus according to claim 1, wherein said acoustic wave generation device is provided in direct contact with a perimeter face of the channel of said annular tube.

3. The acoustic refrigeration apparatus according to claim 2, wherein said acoustic wave generation device is provided in close proximity to said regenerator to generate an acoustic wave set at a resonant frequency of said annular tube.

4. The acoustic refrigeration apparatus according to claim 3, wherein a cold heat exchanger is provided beside said regenerator in said annular tube at a closer side to said acoustic wave generation device and a hot heat exchanger is provided beside said regenerator in said annular tube at a farther side from to said acoustic wave generation device.

5. The acoustic refrigeration apparatus according to claim 2, wherein said acoustic wave generation device is provided at a position approximately 8/24 to 11/24 of a path length of said annular tube distant from said regenerator along said annular tube path to generate an acoustic wave at a resonance frequency of said annular tube.

6. The acoustic refrigeration apparatus according to claim 5, wherein said acoustic wave generation device is provided at a position approximately 10/24 of said annular tube path length distant from said regenerator.

7. The acoustic refrigeration apparatus according to claim 5, wherein a hot heat exchanger is provided beside said regenerator in said annular tube at a closer side to said acoustic wave generation device and a cold heat exchanger is provided beside said regenerator in said annular tube at a farther side from said acoustic wave generation device.

8. The acoustic refrigeration apparatus according to claim 5, wherein a hot heat exchanger is provided beside said regenerator in said annular tube at a closer side to said acoustic wave generation device side and a cold heat exchanger is provided beside said regenerator in said annular tube at a farther side from said acoustic wave generation device.

9. The acoustic refrigeration apparatus according to claim 1, wherein said acoustic wave generation device is provided to a branch from said channel.

10. The acoustic refrigeration apparatus according to claim 9, wherein said acoustic wave generation device generates an acoustic wave at a resonance frequency of the assembled tube with said annular tube and said branch tube, and at a position approximately 3% to 18% of the path length of said annular tube distant from the channel of said annular tube along a branch tube branching from the channel, and the branch is connected to the channel in close proximity to said regenerator.

11. The acoustic refrigeration apparatus according to claim 10, wherein a hot heat exchanger is provided beside said regenerator at a farther side from said acoustic wave generation device, and a cold heat exchanger is provided beside said regenerator in said annular tube at a closer side to said acoustic wave generation device with respect to said regenerator.

12. The acoustic refrigeration apparatus according to claim 9, wherein said acoustic wave generation device is provided at a position approximately 3% to 18% of said annular tube path length distant from the channel of said annular tube along a branch tube branching from the channel of said annular tube to generate an acoustic wave at a resonance frequency of said annular tube and said branch tube is connected to a location approximately 8/24 to 11/24 of said annular tube path length distant from said regenerator along said annular tube path.

13. The acoustic refrigeration apparatus according to claim 12, wherein said branch tube is provided at a position approximately 10/24 said annular tube path length distant from said regenerator along said annular tube path.

14. The acoustic refrigeration apparatus according to claim 13, wherein a cold heat exchanger is provided beside said regenerator in said annular tube at a farther side from said acoustic wave generation device, and a hot heat exchanger is provided beside said regenerator in said annular tube at a closer side to said acoustic wave generation device.

15. The acoustic refrigeration apparatus according to claim 12, wherein a cold heat exchanger is provided beside said regenerator in said annular tube at a farther side from said acoustic wave generation device: and a hot heat exchanger is provided beside said regenerator in said annular tube at a closer side to said acoustic wave generation device.

* * * * *